United States Patent [19]

D'Elia

[11] Patent Number: 5,000,325

[45] **Date of Patent: * Mar. 19, 1991**

[54] METHOD AND APPARATUS FOR THE SORTING OF MATERIAL

[75] Inventor: Ronald J. D'Elia, Greenwich, Conn.

[73] Assignee: Delco Associates, Inc., Greenwich, Conn.

[ * ] Notice: The portion of the term of this patent subsequent to Nov. 14, 2006 has been disclaimed.

[21] Appl. No.: 314,463

[22] Filed: Feb. 22, 1989

Related U.S. Application Data

[62] Division of Ser. No. 175,166, Mar. 30, 1988, Pat. No. 4,880,121.

[51] Int. Cl.[5] ..... B07C 7/04

[52] U.S. Cl. ..... 209/702; 209/900; 211/10; 323/33

[58] Field of Search ..... 209/702, 703, 900; 211/10, 12, 71, 134; 248/95, 99; 383/16, 21, 22, 33, 95

[56] References Cited

U.S. PATENT DOCUMENTS

| | | | |
|---|---|---|---|
| 59,883 | 11/1866 | Whitaker | 211/12 |
| 527,402 | 10/1894 | Brubaker | 383/120 X |
| 1,205,213 | 11/1916 | Johnson | 211/10 X |
| 3,295,694 | 1/1967 | Nejezchleb et al. | 211/12 X |
| 3,578,236 | 5/1971 | Arai | 383/33 |
| 3,659,775 | 5/1972 | Truman | 383/120 |
| 4,249,663 | 2/1981 | Hewlett | 209/705 |
| 4,467,989 | 8/1984 | Stroh | 248/99 X |
| 4,732,279 | 3/1988 | Gurkin | 209/702 |

FOREIGN PATENT DOCUMENTS

| | | | |
|---|---|---|---|
| 2404482 | 6/1979 | France | 211/12 |

*Primary Examiner*—Donald T. Hajec
*Attorney, Agent, or Firm*—Ladas & Parry

[57] ABSTRACT

A method and apparatus for the sorting of material in which a rigid rack includes a plurality of horizontally extending elements arranged in vertically spaced arrangement, and a plurality of bags are removably supported on the horizontally extending elements for receiving material therein. The horizontally extending elements and the bag members are respectively constructed and arranged to hold the bag members with their mouth portions stretched open and facing forwardly one above the other on the rack. The rack further includes elements for maintaining the bag members substantially horizontally one above the other with their mouth portions open. The bag members are selectively removed from the frame with the inserted material therein by horizontally sliding the bag member off the frame.

10 Claims, 3 Drawing Sheets

METHOD AND APPARATUS FOR THE SORTING OF MATERIAL

This is a divisional of application Ser. No. 175,166 filed 3/30/88 now U.S. Pat. No. 4,880,121.

FIELD OF THE INVENTION

The invention relates to a method and apparatus for the sorting of material and particularly to sorting mail.

BACKGROUND

Generally, in sorting mail conventionally, separate bags are provided in which sorted mail is deposited, and after the bags are filled, they are removed from a support and the contents are distributed.

In the case of incoming mail, the contents are removed from the bag and distributed to the designated parties.

In the case of outgoing mail, the bags are transported to the postal authorities for separate dispatch to the particular location.

Currently, in widespread usage are racks which hold cloth bags in a vertically suspended relation adjacent to one another, and the sorted mail is introduced into the respective sacks. After the bags are filled, they are removed from the rack and dispatched to the receiving party which may be the postal authorities or internal distribution in a facility.

In general, the bags are provided with holes at their open mouths which are reinforced with metal ferrules. Releasable hooks engage in the holes and are attached to the rack in order to suspend the bags therefrom.

Another system which is known employs a portable cart on which a plurality of folders can be suspended in adjacent relation so that mail can be sorted by separate placement in the respective folders. Because the folders are generally grouped in tightly packed relation, there is possibility of misdirecting mail by placing it into the wrong folder.

Also known in the art are mobile carts with separate stacking baskets for receiving sorted mail. The baskets are formed of wire members and they can be removable. In order to dispatch the sorted mail to a destination, it is necessary to remove the sorted mail and place it into a separate envelope.

Also known are modular systems in which rigid containers can be supported for receiving sorted mail; the sorted mail can either be removed from the rigid containers and put into separate bags or the rigid containers themselves can be used to be dispatched through the mails with their contents.

SUMMARY OF THE INVENTION

An object of the invention is to provide a method and apparatus for the sorting of material, especially mail. Another object of the invention is to provide a method and apparatus in which separate bag members can be easily and rapidly mounted on and removed from a rack for facilitated sorting of the mail.

A further object of the invention is to provide a method and apparatus of the above type by which the bag members themselves can be utilized for direct mailing.

In accordance with the invention, the bag members are made flexible and they are supported from the rack in a substantially horizontal position, one above the other, in a condition in which mouth portions of the bag members are stretched open and face forwardly.

In the mounted condition of the bag members, mail can be sorted therein, and when it is desired to remove a bag member from the rack, it is released therefrom and the open mouth is closed.

The bag member is of a type which it itself can be sent through the mail.

In this way, the sorting system and method of the invention avoid the double handling of mail by sorting the mail directly into the bag members which serves as flexible mailing containers.

In accordance with a feature of the invention, wire loops are formed on the rack in spaced relation one above the other for engaging respective bag members to hold their mouth portions open.

According to one embodiment of the invention, the wire loops face forwardly and the bags are formed with elastic loops at opposite sides thereof for engaging the wire loops to hold the mouth portion of the bag member open due to stretching of the elastic loops on the wire loops.

Each bag member has a gusset fold at each of its side edges which allow the bag member to be folded flat in stored or unused condition and the gusset folds are unfoleded when the elastic loops are stretched onto the wire loops of the rack.

In the case where the bag members need not be sealed for example, when used for internal transport, a connection means can be provided on the front and rear panels of each bag member for releasable closure of the mouth of the bag member. The connection means can be in the form of VELCRO strips consisting of a strip of hooks on one panel and a strip of loops on the other panel.

According to another embodiment of the invention in which the bag members are particularly adapted for direct delivery to mail or courier services, the elastic loops are eliminated. In this embodiment, the rack is formed with rearwardly extending wire loops onto which the bag members are engaged by insertion of the wire loops into bag members. In this way, the wire loops support the bag members with their mouth portions stretched into open condition. In this embodiment, the bag member is formed with a gusset fold at the edge remote from the mouth portion and the rest of the bag is continuous throughout the remainder of its body.

DETAILED DESCRIPTION OF PREFERRED EMBODIMENTS OF THE INVENTION

Figure 2:
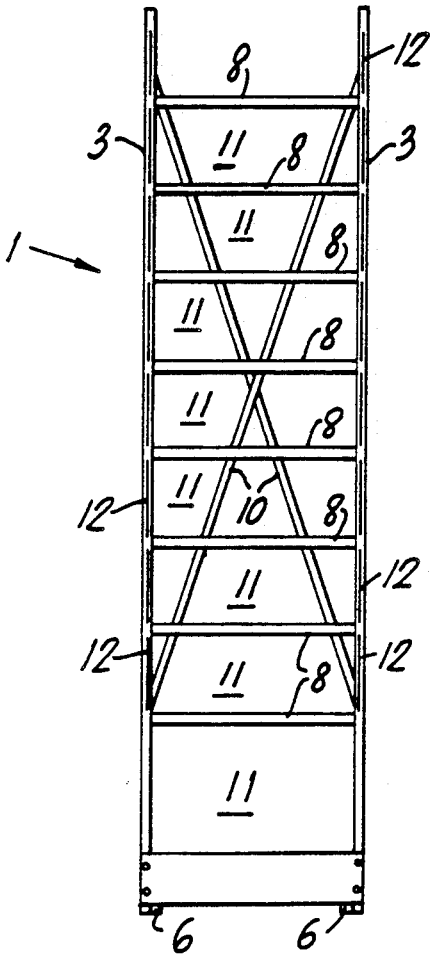
FIG. 2 is a front view of the rack.

With reference to FIGS. 1-6, therein is seen a mail sorting system according to the invention which comprises a mobile rack frame 1 adapted for releasably supporting a plurality of flexible bag members B in substantially horizontal disposition in vertically spaced arrangement.

The frame comprises a base 2 from which extend front uprights 3 in the form of bars, rear uprights 4 also in the form of bars and a main back support 5. A pair of wheels 6 are mounted at the base of the frame for mobile transport thereof. At rest, the lower edges 7 of the front uprights 3 rest on the ground and together with the wheels 6 provide a stable support for the frame. When the frame is moved, the front edges 7 are raised from the ground by tilting the frame slightly upwards on wheels 6 so that the frame is now ready for rolling on the wheels 6.

The uprights 3 and 4 extend generally parallel to one another. A plurality of horizontally extending elements in the form of horizontal shelves 8 are connected to the uprights in vertically spaced relation to one another. A plurality of retainer wires 9 are connected to the shelves 8 at each side of the rack. The retainer wires extend generally parallel to the uprights 3 and 4. In order to confer rigidity to the frame, a pair of reinforcing elements 10 are connected in crossing relation to the upright 5 as shown in FIG. 2 (but omitted in FIG. 3 for purposes of simplification.

By virtue of the above construction, the rack 1 is formed with a succession of pockets 11 arranged one above the other and having open mouths at the front of the rack 1.

Figure 1:
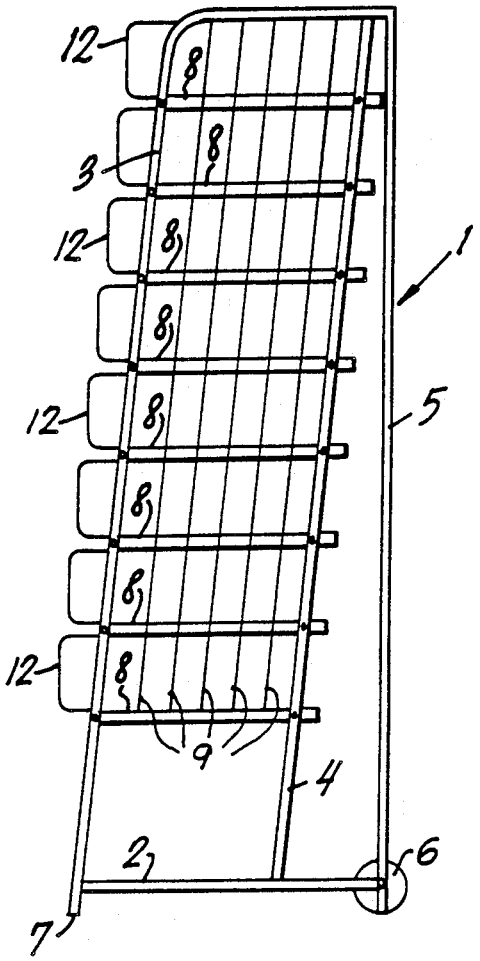
FIG. 1 is a side elevational view of a rack for the mail sorting system of the invention.
Figure 3:
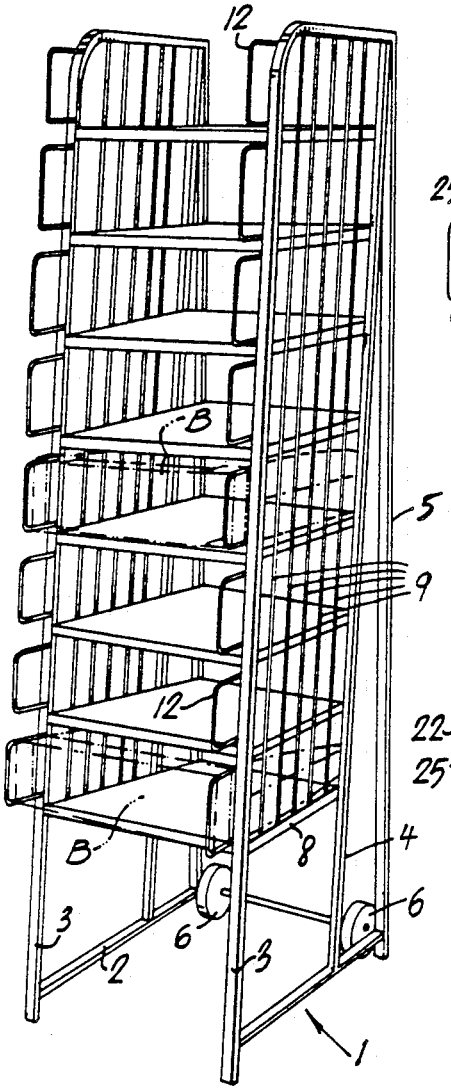
FIG. 3 is a perspective view in which two bags are shown at selected locations in phantom outline to indicate how the bags are mounted on the rack.

Projecting elements 12, in the form of wire loops, are secured to the front uprights 3 at the sides of each pocket 11. As seen in FIG. 1 the uprights 3 are inclined to the vertical and the elements 12 project forwardly from the uprights 3 so that they are progressively rearwardly disposed upwardly along the rack.

Each bag member B is composed of a woven fabric material, such as polyethylene, and is formed with gusset folds 21 and 22 at the side edges thereof. The bag member has an open mouth 23 at one end and the bag is heat sealed to form a closure 24 at the end opposite the open mouth 23. At the open mouth 23 a pair of elastic loops 25 are secured to front and rear panels 26 and 27 respectively. The loops 25 extend laterally beyond the side edges of the bag member. An openable closure means is formed on the bag member at mouth 23 in order to enable closing the mouth of the bag which is otherwise open. The closure means is in the form of confronting or aligned strips 28 and 29 of the type available under the trademark VELCRO. As known, one of the strips is formed with hooks while the other of the strips is formed with loops. The strips releasably engage one another when pressed together.

In order to releasably mount a bag member B on the rack, the opposite loops 25 of the bag member are manually held and engaged over the projecting elements 12 so that the loops are stretched and the bag member is held with its mouth 23 stretched open and facing forwardly on the rack. Each bag member rests on a respective shelf 8.

Figure 4:
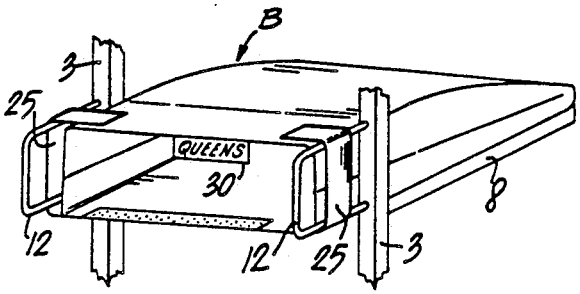
FIG. 4 is an enlarged view showing the installation of one of the bag members in mounted condition on a portion of the rack.
Figure 5:
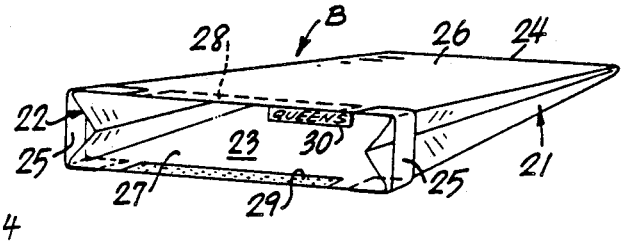
FIG. 5 shows the bag member in partly opened condition.

In operation, the bag members are supported in respective pockets 11 in vertically superposed relation and mail or other material to be sorted is introduced into the open mouths of the respective bags according to its destination. In order to identify the destination of the sorted material in the respective bag, each bag can be provided with an integral identification tag 30 which falls into a vertical position when the bag is mounted on the rack to indicate to the user the destination of the bag. The tag 30 is connected to the upper panel 26 and is folded flat against the panel when the bag is folded flat, and the strips 28 and 29 are releasably engaged. After the bag has been filled with sorted material, the tag can be pivoted forwardly in order to lie outside the bag after the closure strips 28 and 29 have been engaged. In this way the destination of the filled bag will be revealed. The tag can be a pocket made of transparent plastic material and can receive a removable card indicating destination, for example, QUEENS as shown in FIGS. 4 and 5.

Figure 6:
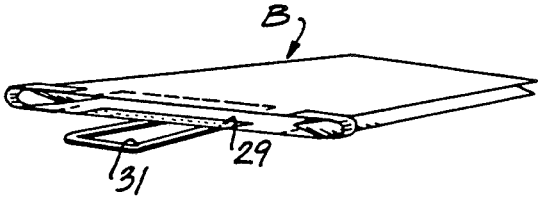
FIG. 6 shows the bag member in substantially flat condition.

As shown in FIG. 6 but omitted in the other figures, the bag B can be provided with a handle 31 to facilitate transport of the bags. The handle 31 can be secured to the bag in common with the stitching used to secure strip 29 to the bag.

Figure 7:
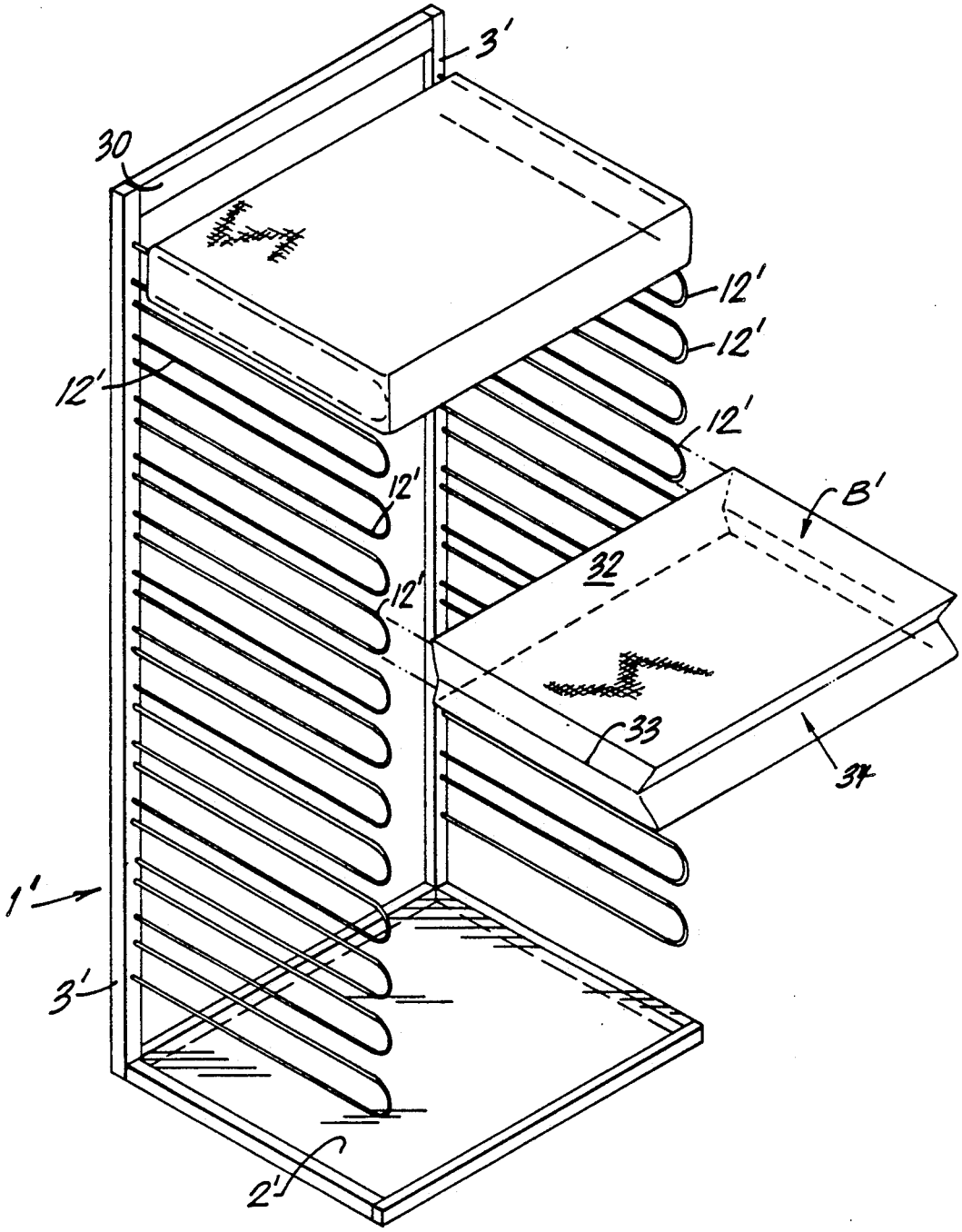
FIG. 7 is a diagrammatic rear perspective view of another embodiment of a mail sorting system according to the invention.

FIG. 7 diagrammatically illustrates another embodiment of the invention. In this embodiment there is provided a rack 1' which is simpler in construction than that in the first embodiment in that the rack omits the shelves 8. The rack 1' is formed with front uprights 3' connected at the top by a crossbrace 30. The front uprights 3' are connected to the front of a weighted base 2'. Rear wheels are optional on the rack and these rear wheels can be connected to the weighted base 2' in the manner shown in the first embodiment.

The support means for the bag members are constituted by rearwardly projecting elements in the form of wire loops 12' arranged in horizontal pairs in vertically spaced relation one above the other. The wire loops 12' in the embodiment of FIG. 7 are substantially longer than the wire loops 12 in the first embodiment.

The rack 1' is intended to cooperate with a bag B' of slightly different construction from that of the first embodiment. The bag B' does not utilize elastic loops at the sides of the bag at the open mouth as in the first embodiment, but is composed of a continuous woven material with a gusset fold 34 at its rear edge and an open mouth 32 at its front edge.

In order to mount the bags on the rack, the bag is fitted over a pair of horizontally aligned loop members 12' so that the bag is held in stretched condition with its mouth 32 open at the front of the rack. The loop members 12' are of a length to extend sufficiently deeply into the respective bag member to support the bag members in horizontal attitude and hold their mouth portion open. In this way the wire loop members 12' serve as the means for supporting the bag members and for holding the mouth portions thereof open.

In order to form the bag B' as a continuous element without side folds, the bag is formed in one piece with the gusset fold 34 and is heat sealed along opposite edges at 33. The bag has a sufficient resilience to be stretched when applied over the wire loops 12'.

The embodiment of FIG. 7 is particularly adapted for use where the bags B directly serve as mailing envelopes and after the filled envelopes are removed by slidably displacing the envelopes rearwardly along the wire loops 12', the bags are then sealed, for example with pressure sensitive tape. Postage and destination labels are then applied and the bags are directly mailed. As in the first embodiment, the labels can be secured to the bags to identify them for sorting purposes and the labels can be utilized for mailing purposes after the bags have been sealed.

The bag B′ has been illustrated for engagement with a respective pair of horizontally aligned wire loops 12′. The invention is also applicable to bags of double depth in which each bag would then be engaged over two wire loops at each side.

According to the method of use of the invention, a succession of flexible bags are mounted one above the other in vertically spaced superposed relation, either on rigid frame 1 or 1′ such that the bags extend horizontally and the bags are releasably held on the frame so that the mouths of the bags are stretched open and material can be inserted into the open bags. After the bags have been filled, they are selectively removed from the frame together with the inserted material therein by horizontally sliding the bag off the frame.

In the embodiment of FIG. 7, the mouths of the bags are stretched open when the bags are engaged on the loop members 12′ during insertion of the loop members into the bags.

In the embodiment of FIGS. 1–6, the mouths of the bags are stretched open when the bags are held on the frame by stretching the elastic loops 25 on the bags over the loop elements 12 on the frame during mounting.

Although the invention has been described in relation to specific embodiments thereof, it will become apparent to those skilled in the art that numerous modifications and variations can be made within the scope and spirit of the invention as defined in the attached claims.

What is claimed is:

1. A method of sorting material comprising removably mounting a succession of flexible bags one above the other in vertically spaced superposed relation on a rigid frame such that the bags extend substantially horizontally across the frame, forming each bag with an open mouth and elastic loops at each side of the bag proximate the mouth, releasably holding the bags on the frame such that the mouth portion of each of the bags is stretched open by stretching the elastic loops on the bags over horizontally spaced projecting elements provided on the frame, selectively inserting material into respective open bags such that the material is sorted into the respective bags, and selectively removing the bags from the frame with the inserted material therein by horizontally sliding the bags off the frame.

2. A method as claimed in claim 1 in which closure means are attached at the mouth of each said bag for selectively closing the same.

3. A bag as claimed in claim 2 wherein each method is woven of synthetic fabric material.

4. A method as claimed in claim 2 wherein said closure means are formed of hooks and loops which are pressed into engagement.

5. A method as claimed in claim 4 wherein strips of material supporting the hooks and loops are extended along the mouth of each bag in opposed relationship.

6. A bag as claimed in claim 5 wherein each said method is formed with side edges and a gusset fold at each side edge, said elastic loops being joined to the bag element to unfold the gusset folds when stretched.

7. A method as claimed in claim 6 wherein each said bag has front and rear panels and a closed end remote from the mouth, comprising connecting said front and rear panels at said closed end, said elastic loops each having opposite end portions connected to said front and rear panels at said mouth.

8. A method as claimed in claim 7 comprising fastening a strip of hooks on one panel and a strip of loops on the other panel with the strips being aligned with each other.

9. A method as claimed in claim 7 comprising hinging an identification to one of said panels of each loop and arranging the identification to be exposed when the associated bag is opened.

10. A method as claimed in claim 7 comprising attaching a handle to each bag at the mouth thereof and carrying the bags by the handles thereof when the bags are removed from the frame.

* * * * *